US006804370B2

(12) United States Patent
Sugiura

(10) Patent No.: US 6,804,370 B2
(45) Date of Patent: Oct. 12, 2004

(54) SPEAKER CAPABLE TO PLAYBACK IN WIDE FREQUENCY RANGE

(75) Inventor: Hideaki Sugiura, Tendo (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 0 days.

(21) Appl. No.: 10/396,830

(22) Filed: Mar. 26, 2003

(65) Prior Publication Data

US 2003/0185416 A1 Oct. 2, 2003

(30) Foreign Application Priority Data

Mar. 29, 2002 (JP) ..... 2002-094304

(51) Int. Cl.[7] ..... H04R 25/00

(52) U.S. Cl. ..... 381/424; 381/423; 381/430; 381/186

(58) Field of Search ..... 381/423, 424, 381/430, 182, 186, 340, 342, 343, 398, 184; 181/163, 164, 165, 159

(56) References Cited

U.S. PATENT DOCUMENTS 2,058,208 A * 10/1936 Blattner ..... 181/159
4,315,112 A * 2/1982 Hofer ..... 381/423
5,875,252 A * 2/1999 Lesage ..... 381/340
6,320,970 B1 * 11/2001 Czerwinski et al. ..... 381/343

* cited by examiner

*Primary Examiner*—Huyen Le
(74) *Attorney, Agent, or Firm*—Sughrue Mion, PLLC

(57) ABSTRACT

A speaker capable to playback in wide frequency range by means of reducing peak values of amplitude of resonance frequencies in frequency characteristics is provided by means of differing a radius of curvature R1 of an inner diaphragm 10*a* and a radius of curvature R2 of an outer diaphragm 10*b* to differ resonance frequencies of the inner diaphragm 10*a* and the outer diaphragm 10*b*. Furthermore, by means of equalizing an area S1 of the inner diaphragm 10*a* and an area S2 of the outer diaphragm 10*b*, sound pressure levels of the inner and outer diaphragms 10*a*, 10*b* are equalized with each other.

7 Claims, 5 Drawing Sheets

SPEAKER CAPABLE TO PLAYBACK IN WIDE FREQUENCY RANGE

BACKGROUND OF THE INVENTION

1. Field of the Invention

This invention relates to a speaker, especially a speaker having a diaphragm having a ring-shape inner diaphragm, a voice coil being mounted on an outer edge thereof, and a ring-shape outer diaphragm, the voice coil being mounted on an inner edge thereof.

2. Description of the Related Art

A speaker generally includes a diaphragm for generating sound wave, a voice coil bobbin formed integrally with the diaphragm and elastically supported by a damper to be vibrated, and a voice coil wound around the voice coil bobbin and disposed in a magnetic gap.

The diaphragm is vibrated through the voice coil bobbin by flowing electric current according to playback sound in the voice coil, so that this speaker generates sound wave as acoustic energy.

Objects to be Solved

Recently, DVD player becomes popular so that a speaker is required to have capability for playback in wide frequency range. Therefore, it is expected to eliminate a sound noise as much as possible by means of reducing a peak value of amplitude at resonance frequency in frequency characteristics of a speaker.

This invention has been accomplished to realize the above expectation and an object of this invention is to provide a speaker capable to playback in wide frequency range by means of reducing a peak value of amplitude of resonance frequency in frequency characteristics of a speaker.

SUMMARY OF THE INVENTION

How to Attain the Object

In order to attain the objects, a speaker according to this invention, includes a diaphragm having a ring-shape inner diaphragm, a voice coil mounted on an outer edge of the inner diaphragm, and a ring-shape outer diaphragm, the voice coil mounted on an inner edge of the outer diaphragm, wherein resonance frequencies of the inner diaphragm and the outer diaphragm are differed from each other.

In the above-mentioned speaker, resonance frequencies of the inner diaphragm and the outer diaphragm are different. Therefore, in frequency characteristics of the whole diaphragm synthesized with frequency characteristics of the inner diaphragm and frequency characteristics of outer diaphragm, a peak value of amplitude at resonance frequency can be reduced and the curve of frequency characteristics becomes flatter.

Furthermore, in the speaker according to the invention as referred to above, the inner diaphragm and the outer diaphragm are respectively formed with curvature along their radial directions thereof, and radii of curvatures of the surfaces having the curvatures of the inner and outer diaphragms are differed from each other.

In the above-mentioned speaker, to differ radii of curvatures of the inner and outer diaphragms, resonance frequencies of the inner diaphragm and the outer diaphragm can be easily differed from each other. In addition, deformation and/or split vibration of the diaphragm at high frequency can be prevented by means of curving the surface.

Furthermore, in the speaker according to the invention as referred to above, an angle formed between a straight line perpendicular to a direction of winding wire of the voice coil and a tangential line to the curved surface of the inner diaphragm at the outer edge of the inner diaphragm and an angle formed between a straight line perpendicular to a direction of winding wire of the voice coil and a tangential line to the curved surface of the outer diaphragm at the inner edge of the outer diaphragm are differed from each other.

In the above-mentioned speaker, to differ the angle formed between the straight line perpendicular to the direction of winding wire of the voice coil and the tangential line to the curved surface of the inner diaphragm at the outer edge of the inner diaphragm and the angle formed between the straight line perpendicular to the direction of winding wire of the voice coil and the tangential line to the curved surface of the outer diaphragm at the inner edge of the outer diaphragm, resonance frequencies of the inner diaphragm and the outer diaphragm can be easily differed from each other. In addition, deformation and/or split vibration of the diaphragm at high frequency can be prevented by means of curving the surface.

Furthermore, in the speaker according to the invention as referred to above, the inner diaphragm and the outer diaphragm are respectively formed with curvature along their radial direction thereof, and radii of curvatures of the surfaces having the curvatures of the inner and outer diaphragms are differed from each other, and the angle formed between the straight line perpendicular to a direction of winding wire of the voice coil and the tangential line to the curved surface of the inner diaphragm at the outer edge of the inner diaphragm and the angle formed between the straight line perpendicular to a direction of winding wire of the voice coil and the tangential line to the curved surface of the outer diaphragm at the inner edge of the outer diaphragm are differed from each other.

In the above-mentioned speaker, to differ radii of curvatures of the inner and outer diaphragms, and to differ the angle formed between the straight line perpendicular to the direction of winding wire of the voice coil and the tangential line to the curved surface of the inner diaphragm at the outer edge of the inner diaphragm and the angle formed between the straight line perpendicular to the direction of winding wire of the voice coil and the tangential line to the curved surface of the outer diaphragm at the inner edge of the outer diaphragm, resonance frequencies of the inner diaphragm and the outer diaphragm can be easily differed from each other. In addition, deformation and/or split vibration of the diaphragm at high frequency can be prevented by means of curving the surface.

Furthermore, in the speaker according to the invention as referred to above, areas of the inner diaphragm and the outer diaphragm are equalized with each other.

In the above-mentioned speaker, to equalize areas of the inner diaphragm and the outer diaphragm, sound pressure levels of the inner diaphragm and the outer diaphragm are equalized with each other, in other words, peak values of amplitudes at respective resonance frequencies of the inner diaphragm and the outer diaphragm can be equalized with each other. Therefore, the peak value of amplitude at the resonance frequency of the whole diaphragm can be reduced more and the curve of frequency characteristics becomes flatter.

Furthermore, in the speaker according to the invention as referred to above, the speaker is a horn type.

In the above-mentioned speaker, an efficiency of generating a sound wave can be increased by using a horn type speaker.

Furthermore, in the speaker according to the invention as referred to above, the inner diaphragm and the outer diaphragm are formed integrally.

In the above-mentioned speaker, forming the inner diaphragm and the outer diaphragm integrally, the inner diaphragm and the outer diaphragm can be manufactured easily and the voice coil can be also easily mounted on the diaphragm.

Furthermore, in the speaker according to the invention as referred to above, the resonance frequencies are in high-frequency range.

In the above-mentioned speaker, the peak values of amplitudes at high frequency are reduced so that the curve of frequency characteristics becomes flatter.

The above and other objects and features of this invention will become more apparent from the following description taken in conjunction with the accompanying drawings.

DESCRIPTION OF THE PREFERRED EMBODIMENT

Figure 1:
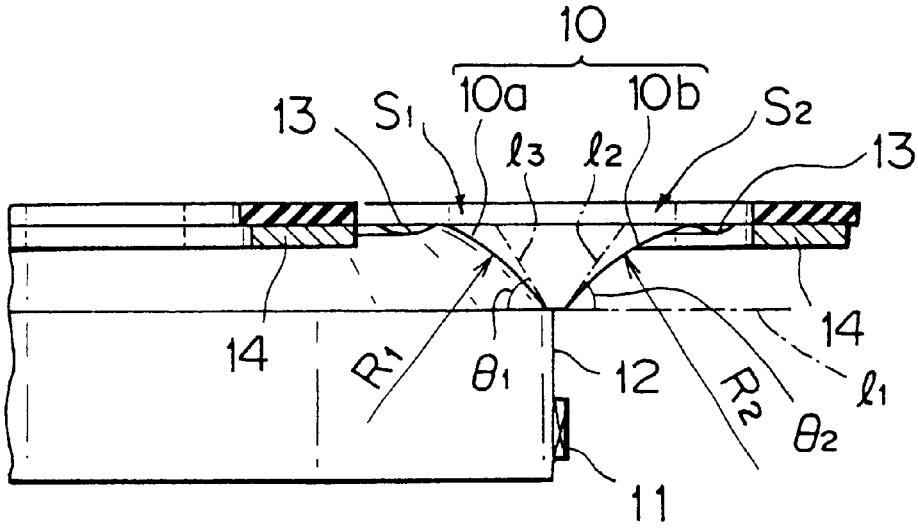
FIG. 1 is a sectional view of an embodiment of a diaphragm structuring a speaker according to the invention.

A speaker according to this invention will be described with reference to drawings. FIG. 1 is a sectional view of an embodiment of a diaphragm structuring a speaker according to this invention.

The speaker, as shown in FIG. 1, has a diaphragm 10 to be vibrated for generating a sound wave. The diaphragm 10 is formed with a ring shape inner diaphragm 10*a* and a ring shape outer diaphragm 10*b*. A voice coil 11 is wound around a voice coil bobbin 12. The voice coil bobbin 12 is mounted at an outer edge of the inner diaphragm 10*a* and at an inner edge of the outer diaphragm 10*b*.

An inner edge of the inner diaphragm 10*a* and an outer edge of the outer diaphragm 10*b* are fixed through ring-shape edge members 13 having suitable compliance and stiffness on a frame 14. The diaphragm 10 and the voice coil bobbin 12 can be elastically supported by means of the edge members 12. Preferably, the inner diaphragm 10*a* and the outer diaphragm 10*b* may be formed integrally. Preferably, the inner and outer diaphragms 10*a*, 10*b* and the voice coil bobbin 12 may be formed integrally.

The inner diaphragm 10*a* and the outer diaphragm 10*b* are respectively formed with curvature along a radial direction thereof. R1 in FIG. 1 shows a radius of curvature of a curved surface formed on the inner diaphragm 10*a* and R2 in FIG. 1 shows a radius of curvature of a curved surface formed on the outer diaphragm 10*b*. Differing the radius of curvature R1 of the inner diaphragm 10*a* and the radius of curvature R2 of the outer diaphragm 10*b*, resonance frequencies of the inner diaphragm 10*a* and the outer diaphragm 10*b* can be differed from each other.

Furthermore, according to a speaker of this invention, by equalizing areas of the inner diaphragm and the outer diaphragm, sound pressure levels of the inner diaphragm and the outer diaphragm are equalized with each other.

Figure 2B:
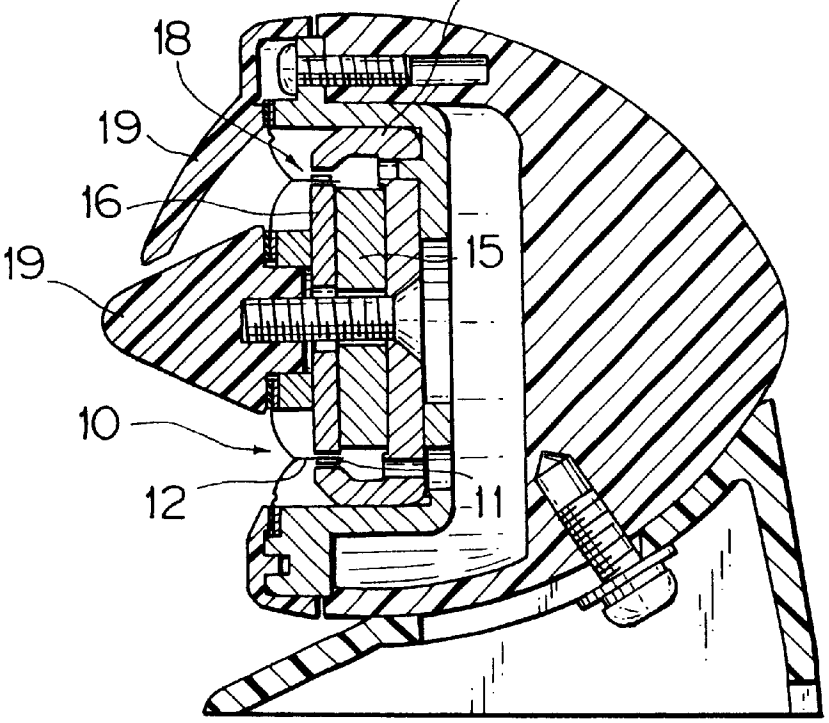
FIG. 2B is a sectional view taking along the line A–A' in FIG. 2A.
Figure 2A:
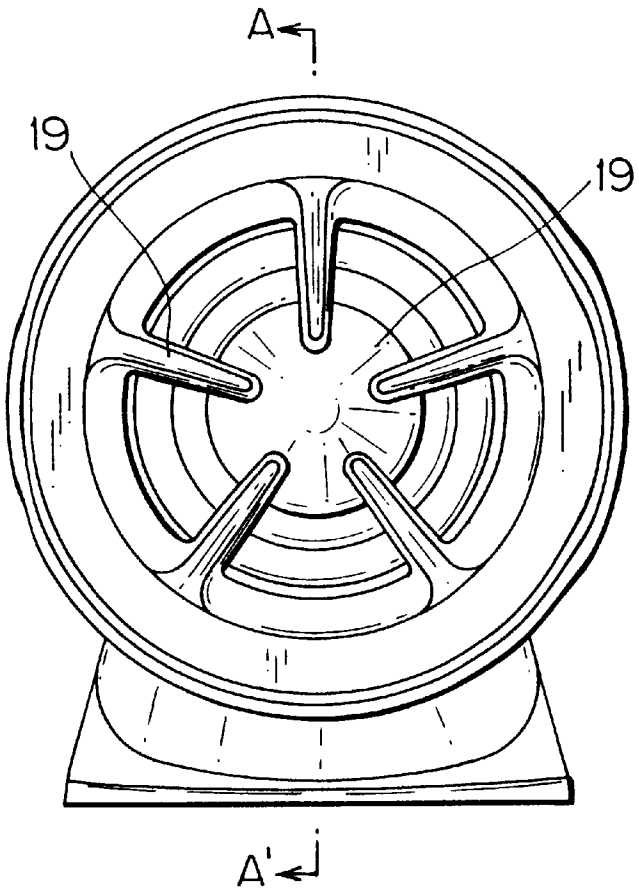
FIG. 2A is a front view of the embodiment of a speaker on which the diaphragm in FIG. 1 is mounted.

FIGS. 2A, 2B show a speaker provided with the above-mentioned diaphragm. FIG. 2A shows a front view of the speaker and FIG. 2B shows a sectional view taking along the line A–A' in the front view. As shown in FIGS. 2A, 2B, the speaker furthermore includes a magnet 15, a top plate 16 disposed on a top surface of the magnet 15, and a yoke 17 disposed on a bottom surface of the magnet 15 and around the magnet 15. A protection member 19 for protecting the diaphragm 10 is provided on a front surface of the diaphragm 10.

A magnetic gap 18 is formed between the top plate 16 and the yoke 17. Above-mentioned respective components structure a magnetic circuit which flux path is formed through the top plate 16, the magnetic gap 18, the yoke 17, the magnet 15 and back to the top plate 16. The voice coil 11 is located in the magnetic gap 18.

Figure 3A:
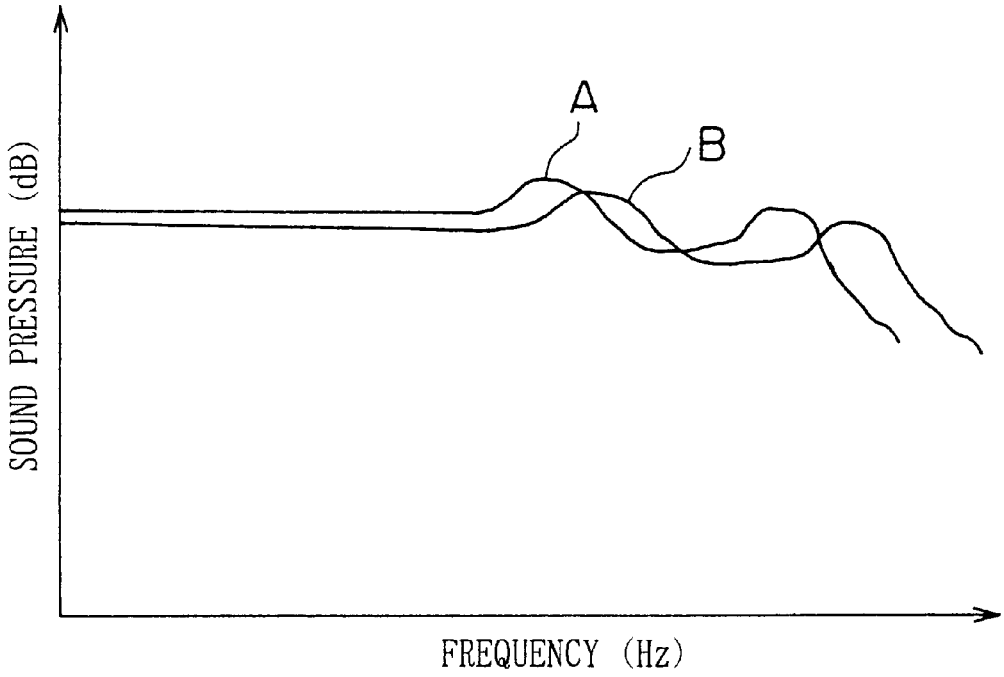
FIG. 3A is a graph showing each frequency characteristics A and B of the inner diaphragm 10*a* and the outer diaphragm 10*b* structuring the speaker in FIG. 2A.

Frequency characteristics of the speaker structured as mentioned above will be described with reference to FIGS. 3A, 3B, 4. FIG. 3A is a graph showing frequency characteristics A of the inner diaphragm and frequency characteristics B of the outer diaphragm.

Deferring the radius of curvature R1 of the inner diaphragm 10*a* and the radius of curvature R2 of the outer diaphragm 10*b* as mentioned above, resonance frequencies of the inner diaphragm 10*a* and the outer diaphragm 10*b* can be differed from each other. Equalizing areas of the inner diaphragm and the outer diaphragm, sound pressure levels of the inner diaphragm and the outer diaphragm can be equalized with each other. In this embodiment, the resonance frequencies are in high frequency range.

Figure 3B:
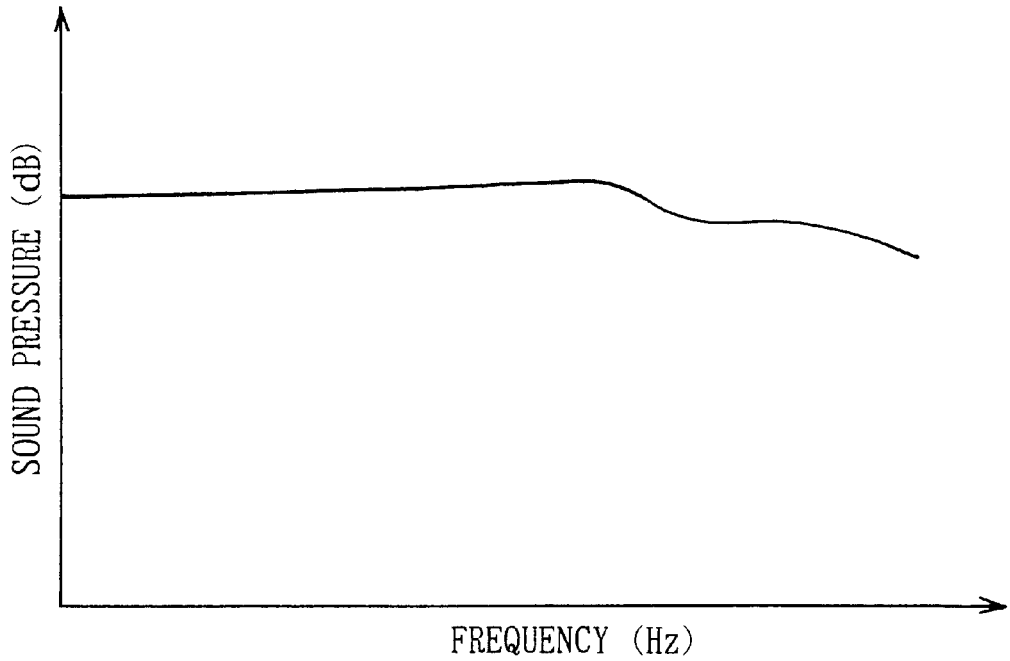
FIG. 3B is a graph showing frequency characteristics of the whole diaphragm 10 structuring the speaker in FIG. 2A.

As shown in FIG. 3B, in frequency characteristics of the whole diaphragm 10, synthesized with the frequency characteristics of the inner diaphragm 10*a* and the frequency characteristics of the outer diaphragm 10*b*, a peak value of amplitude at a resonance frequency in high frequency range and the frequency characteristics can be made flatter shape. Therefore, the speaker according to this invention can be capable to playback in wide frequency range.

Figure 4:
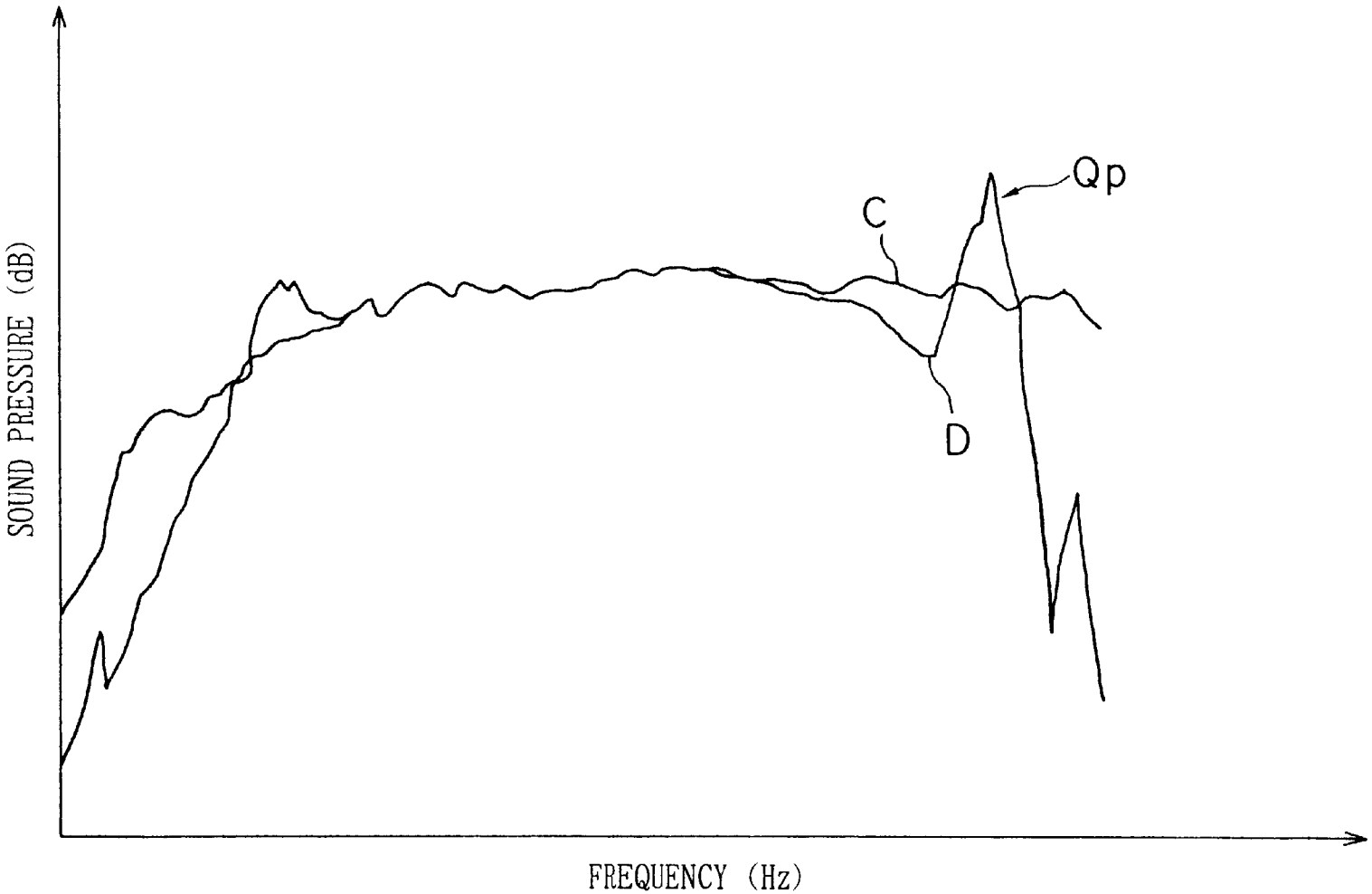
FIG. 4 is a graph showing each frequency characteristics of the speaker according to the invention and the usual speaker.

Above-mentioned effect is obviously shown in FIG. 4 indicating graphs of the frequency characteristics C of the speaker according to this invention and the frequency characteristics D of a usual speaker which the inner diaphragm 10*a* and the outer diaphragm 10*b* have the same resonance frequency. As shown in FIG. 4, in the usual speaker, the peak value Qp of amplitude at the resonance frequency in high frequency range is not reduced and flat area of the frequency characteristics is narrow. In comparison with the usual speaker, the peak value of amplitude at the resonance frequency of the speaker according to this invention is reduced to be hardly recognized and flat area of the frequency characteristics is wide.

According to the above-mentioned speaker, by means of differing the radius of curvature R1 of the inner diaphragm 10*a* and the radius of curvature R2 of the outer diaphragm 10*b*, resonance frequencies of the inner diaphragm 10*a* and the outer diaphragm 10*b* are easily differed from each other. In addition, deformation and/or split vibration of the diaphragm 10 at high frequency can be prevented by means of curving the inner diaphragm 10*a* and the outer diaphragm 10*b*.

In the above-mentioned speaker, by means of equalizing area S1 of the inner diaphragm 10*a* and area S2 of the outer diaphragm 10*b*, sound pressure levels of the inner diaphragm 10*a* and the outer diaphragm 10*b* are equalized with each other, in other words, peak values of amplitudes at respective resonance frequencies of the inner diaphragm 10*a* and the outer diaphragm 10*b* can be equalized with each other so that the peak value of amplitude at the resonance frequency can be reduced more and the curve of frequency characteristics becomes flatter.

In the above-mentioned embodiment, to differ the radius of curvature R1 of the inner diaphragm 10*a* and the radius of curvature R2 of the outer diaphragm 10*b* by means of curving the inner diaphragm 10*a* and the outer diaphragm 10*b*, resonance frequencies of the inner diaphragm 10*a* and the outer diaphragm 10*b* are differed from each other. The method for differing resonance frequencies is not limited by the above-mentioned method, for example, differing a vertical angle $\theta_1$ of the inner diaphragm at the outer edge of the inner diaphragm and a vertical angle $\theta_2$ of the outer diaphragm at the inner edge of the outer diaphragm (see FIG. 1) can be applied.

The vertical angle $\theta_1$ is formed between a straight line $l_1$ perpendicular to a direction of winding wire of the voice coil 11 and a tangential line $l_3$ to the curved surface of the inner diaphragm 10*a* at the outer edge of the inner diaphragm 10*a*. The vertical angle $\theta_2$ is formed between the straight line $l_1$ and a tangential line $l_2$ to the curved surface of the outer diaphragm 10*b* at the inner edge of the outer diaphragm 10*b*. According to this method, the same effect of the above-mentioned embodiment can be given.

Figure 5:
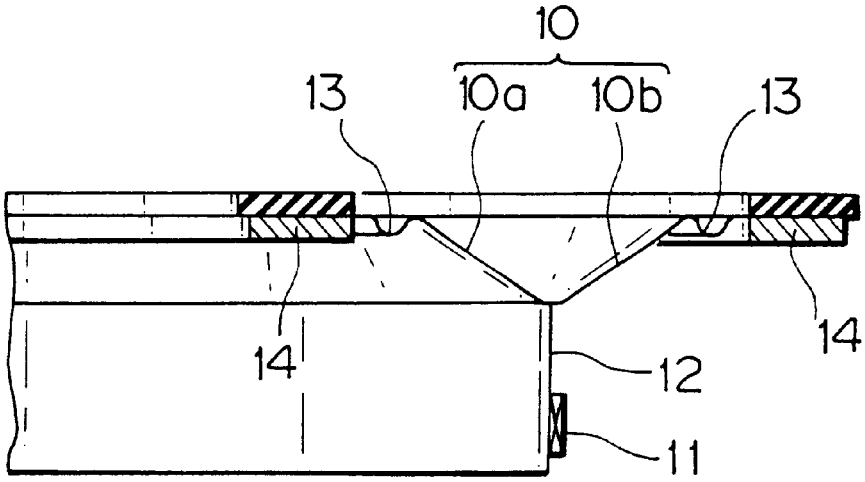
FIG. 5 is a sectional view of the other embodiment of a diaphragm applied in a speaker according to the invention.

In the above-mentioned embodiment, the inner diaphragm 10*a* and the outer diaphragm 10*b* are respectively formed with curvature along the radial direction thereof. This invention is not limited by means of curving the diaphragm and if only resonance frequencies of the inner diaphragm 10*a* and the outer diaphragm 10*b* are deferred, linear shape in the radial direction, as shown in FIG. 5, may be applied on the inner and outer diaphragms. However, according to the linear shape diaphragm, deformation and/or split vibration of the diaphragm 10 at high frequency may be generated so that the above-mentioned diaphragm 10 having deferred the radii of curvature thereof is preferable.

Figure 6B:
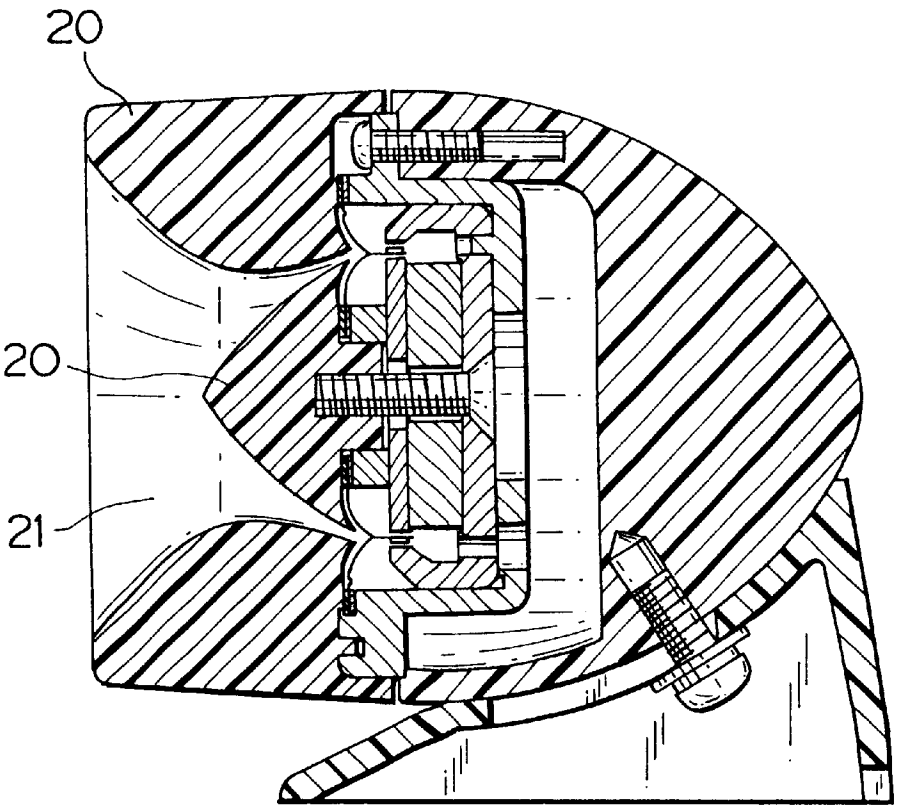
FIG. 6B is a sectional view taking along the line A–A' in FIG. 6A.
Figure 6A:
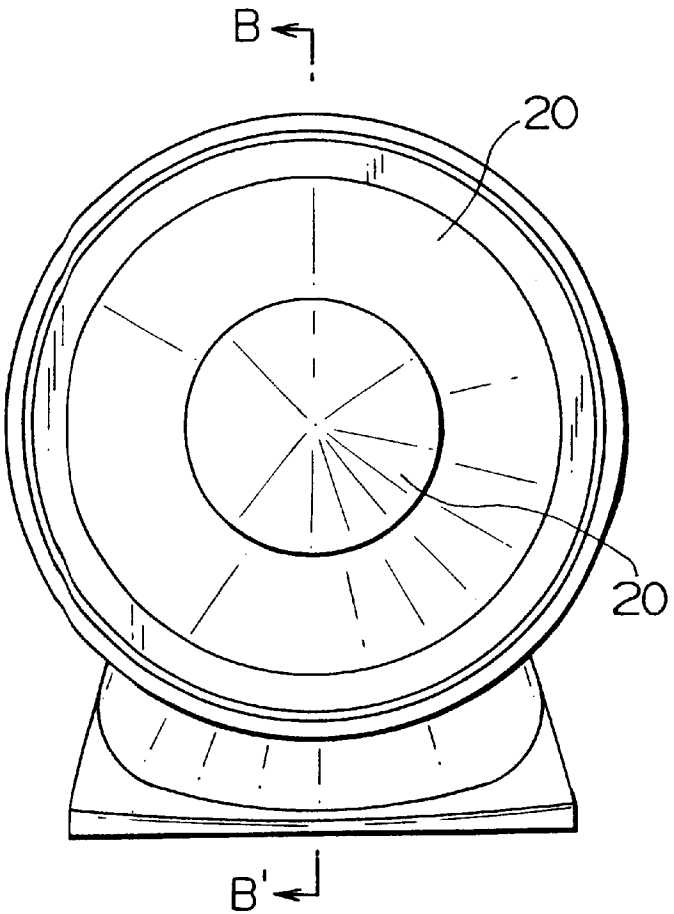
FIG. 6A is a front view of an embodiment of a horn type speaker applied by a speaker according to the invention.

In the above-mentioned embodiment, the speaker is a cone speaker to diffuse directly a sound wave generated by the diaphragm 10. This invention is not limited for the cone speaker, and applied for a horn speaker having a horn 20 for guiding sound wave generated by the diaphragm 10 to an opening end portion 12. FIGS. 6A and 6B show an embodiment of a horn speaker. FIG. 6A is a front view of the horn speaker. FIG. 6B is a sectional view taking along the line B–B' in FIG. 6A. In FIG. 6B, the horn 20 for guiding sound wave by the diaphragm 10 to the opening end portion 21 is provided in front of the diaphragm 10.

Although the present invention has been fully described by way of examples with reference to the accompanying drawings, it is to be noted that various change and modifications can be made with the scope of the present invention. Incidentally, the contents of Japanese Patent Application No. 2002-94304 are hereby incorporated by reference.

What is claimed is:

1. A speaker comprising a diaphragm having a ring-shape inner diaphragm, a voice coil being mounted on an outer edge thereof, and a ring-shape outer diaphragm, said voice coil being mounted on an inner edge thereof, wherein resonance frequencies of said inner diaphragm and said outer diaphragm are differed from each other, and wherein said inner diaphragm and said outer diaphragm are respectively formed with curvature along their radial directions thereof, and radii of curvatures of the surfaces having said curvatures of the inner and outer diaphragms are differed from each other.

2. A speaker comprising a diaphragm having a ring-shape inner diaphragm, a voice coil being mounted on an outer edge thereof, and a ring-shape outer diaphragm, said voice coil being mounted on an inner edge thereof, wherein resonance frequencies of said inner diaphragm and said outer diaphragm are differed from each other, and wherein an angle made by a straight line perpendicular to a direction of winding wire of said voice coil and a tangential line to the curved surface of the inner diaphragm at the outer edge of the inner diaphragm and an angle made by the straight line perpendicular to a direction of winding wire of said voice coil and a tangential line to the curved surface of the outer diaphragm at the inner edge of the outer diaphragm are differed from each other.

3. A speaker comprising a diaphragm having a ring-shape inner diaphragm, a voice coil being mounted on an outer edge thereof, and a ring-shape outer diaphragm, said voice coil being mounted on an inner edge thereof, wherein resonance frequencies of said inner diaphragm and said outer diaphragm are differed from each other, and wherein said inner diaphragm and said outer diaphragm are respectively formed with curvature along the radial direction thereof, and radii of curvatures of curved surfaces formed with said curvatures on the inner and outer diaphragms are differed from each other, and the angle made by the straight line perpendicular to the direction of winding wire said voice coil and the tangential line to the curved surface of the inner diaphragm at the outer edge of the inner diaphragm and the angle made by the straight line perpendicular to the direction of winding wire said voice coil and the tangential line to the curved surface of the outer diaphragm at the inner edge of the outer diaphragm are differed from each other.

4. The speaker according to any one of claims 1–3, wherein areas of said inner diaphragm and said outer diaphragm are equalized with each other.

5. The speaker according to any one of claims 1–3, wherein said speaker is horn type.

6. The speaker according to any one of claims 1–3, wherein said inner diaphragm and said outer diaphragm are formed integrally.

7. The speaker according to any one of claims 1–3, wherein said resonance frequencies are in high-frequency range.

* * * * *